US005865052A

United States Patent [19]

Weinhold et al.

[11] Patent Number: 5,865,052

[45] Date of Patent: Feb. 2, 1999

[54] METHOD AND DEVICE FOR FORMING AND/OR COATING WIRE-SHAPED METAL MATERIAL

[75] Inventors: Harri Weinhold, Kreischa; Bernhard Kurze, Dresden; Gerd Zschorn, Dresden; Armin Huebner, Dresden, all of Germany

[73] Assignees: Ecoform Umformtechnik GmbH; Herborn & Breitenbach GmbH, both of Germany

[21] Appl. No.: 836,215

[22] PCT Filed: Nov. 11, 1994

[86] PCT No.: PCT/EP94/03740

§ 371 Date: May 7, 1997

§ 102(e) Date: May 7, 1997

[87] PCT Pub. No.: WO96/14946

PCT Pub. Date: May 23, 1996

[51] Int. Cl.[6] ..... B21B 45/02

[52] U.S. Cl. ..... 72/43; 72/42; 72/46

[58] Field of Search ..... 72/42, 43, 46, 72/47, 39

[56] References Cited

U.S. PATENT DOCUMENTS

| | | | |
|---|---|---|---|
| 3,854,193 | 12/1974 | Yamaguchi et al. | 72/47 |
| 4,553,416 | 11/1985 | Sudoh et al. | 72/43 |
| 4,683,742 | 8/1987 | Eveson | 72/43 |

FOREIGN PATENT DOCUMENTS

| | | | |
|---|---|---|---|
| A147209 | 3/1981 | Germany . | |
| 1233-007-A | 9/1989 | Japan | 72/47 |
| 1186-314-A | 10/1985 | U.S.S.R. | 72/43 |

OTHER PUBLICATIONS

PCT International Preliminary Examination of corresponding PCT application No. PCT/EP 94/03740, filed Nov. 11, 1994.

*Primary Examiner*—Joseph J. Hail, III
*Assistant Examiner*—Rodney Butler
*Attorney, Agent, or Firm*—McAulay Nissen Goldberg Kiel & Hand, LLP

[57] ABSTRACT

The disclosure concerns the field of metallurgy and relates to a method and device for use in the forming of wire-shaped metal material, in particular in wire drawing. To form and/or coat wire-shaped metal material with solid to paste-consistency lubricants, the material is passed through a pressure chamber fitted with at least one inlet nozzle and at least one outlet nozzle. Located in the pressure chamber is a solid to paste-consistency lubricant which is under pressure. The pressure is set and/or regulated and raised by means of an external pressure-generation unit. The combined pressure/temperature setting used for the lubricant is always kept below the level at which the lubricant would liquefy. The lubricant is used as a powder or in the form of shaped articles, preferably compacts, pellets or granules, and fed to the pressure chamber from lubricant-storage facilities through feed channels.

26 Claims, 3 Drawing Sheets

METHOD AND DEVICE FOR FORMING AND/OR COATING WIRE-SHAPED METAL MATERIAL

BACKGROUND OF THE INVENTION

1. Field of the Invention

The invention relates to the field of metallurgy, especially of wire drawing, and is directed to a method and device for forming and/or coating rod-shaped metal material with lubricants of solid to pasty consistency.

2. Description of the Related Art

In the forming of metal material by means of drawing, solid, semisolid and liquid lubricants are used to produce a lubricant coat on the material to be formed.

In a known process and apparatus for applying solid or semisolid lubricants for cold forming of metal materials, the material to be formed is introduced into a closed chamber containing a lubricant that has been liquefied under the influence of pressure and/or temperature (DD 147 209). The disadvantage of this method and this apparatus consists in that the utilized lubricant has a low viscosity in its liquefied state. This limits the range of possible variations with respect to coating thickness, and a metal material which is coated in this manner can pass through only one or only a few forming steps in view of the meager coating thicknesses (dividing layers) that can be achieved between the two friction partners represented by the forming die and the material to be formed. Moreover, problems arise with respect to the sealing of the inlet nozzle, also as a result of the low viscosity of the lubricant.

Further, methods and apparatus are known in which wire drawing is effected hydrostatically. In one of these devices, the wire passes through a pressure chamber containing a liquid lubricant before entering the drawing stone or drawing die. The lubricant pressure is generated via a pump. For sealing, another drawing die is used as a sealing nozzle at the entrance side of the pressure chamber (J. Schiermeyer, Dissertation TU Clausthal 1979; U.S. Pat. No. 3,413,832). Hydrodynamic lubrication conditions are to be produced in, the main drawing die by this construction of the device.

In the prior art, the sealing of the pressure chamber by means of the sealing nozzle causes problems, since additional lubrication must be carried out in order to realize small forming changes with this sealing nozzle. Another disadvantage consists in that a wire which is already lubricated must be fed to the device. Another disadvantage consists in that the material formed by this device can generally not be used for additional subsequent forming steps without receiving a new coating of lubricant.

OBJECT AND SUMMARY OF THE INVENTION

It is the primary object of the invention to configure a method and a device for forming and/or coating rod-shaped metal material with solid to pasty-consistency lubricants with the use of a pressure chamber for the lubricant such that sealing problems in connection with the pressure chamber are considerably alleviated and one or more technical parameters in the forming and coating process can be decisively improved at the same time depending upon the respective material to be formed.

This object is met by the present invention.

In the method according to the present invention for forming and/or coating rod-shaped metal material with solid to pasty-consistency lubricants, the rod-shaped metal material runs into a pressure chamber through at least one inlet nozzle and exits the pressure chamber through at least one outlet nozzle, solid to pasty lubricant is introduced into the pressure chamber, pressure is applied externally to the solid to pasty lubricant located in the pressure chamber, wherein the applied combination of pressure and temperature always lies outside of the range of pressure-temperature combinations at which the utilized lubricant would liquefy, and the pressure in the pressure chamber is set and/or regulated.

The method is advantageously used one or more times in a multiple-step forming process.

Further, in an advantageous manner, the relative movement between the material to be formed and the forming die is temporarily reversed during the forming process immediately after an interruption in the forming process and/or the pressure applied to the lubricant is reduced.

Likewise advantageously, a material having a reaction layer is formed, wherein the reaction layer detaching from the material while it is undergoing forming is embedded in the lubricant on the material and is subsequently removed together with the lubricant.

Also, lubricant is advantageously introduced into the pressure chamber by a lubricant feed and, in so doing, is stored in an oppositely located lubricant storage, wherein a chargeable energy storage element is charged. The energy storage element is discharged during the reloading of the lubricant feed so that the stored lubricant is pressed in the pressure chamber.

Further, the rod-shaped metal material advantageously runs through an adjoining hydrodynamic pressure nozzle following the pressure chamber for coating and forming or through an adjoining chamber for coating.

It is also advantageous that the rod-shaped metal material runs through a plurality of successive hydrodynamic pressure nozzles for coating and forming or a plurality of successive chambers for coating.

It is also advantageous that the solid lubricant is introduced into the pressure chamber as powder or as a molded body, preferably as a compact or pellet or granule.

Also, the material to be formed is advantageously guided centrally in the pressure chamber through a directed flow of the introduced lubricant.

It is further advantageous when heated material is fed to the pressure chamber.

It is likewise advantageous that the lubricant is heated and/or cooled.

The device according to the invention for forming and/or coating rod-shaped metal material with solid to pasty lubricants contains a pressure chamber with at least one inlet nozzle and at least one outlet nozzle through which the material to be formed passes, at least one feed for solid to pasty lubricant, solid to pasty lubricant under pressure in the pressure chamber, wherein the pressure is applied externally and wherein the applied combined pressure and temperature is always outside of the range of pressure-temperature combinations for liquefaction of the utilized lubricant, and at least one apparatus for generating pressure, wherein the pressure is set and/or regulated by means of this apparatus or by at least one additional apparatus for setting and/or regulating pressure.

For purposes of forming, it is advantageous that only the outlet nozzle is constructed as a drawing die.

Further, two oppositely located lubricant feeds are advantageously provided, which introduce solid to pasty lubricant into the pressure chamber, wherein the solid lubricant is used as a powder or molded body, preferably as compacts or pellets or granules.

The pressure is also advantageously generated hydraulically.

It is further advantageous when a flow divider divides the flow of lubricant before it reaches the metal material in the pressure chamber.

And it is likewise advantageous to provide a lubricant feed and, opposite thereto, a lubricant storage with a chargeable energy storage element. In so doing, lubricant is pressed into the lubricant storage and the energy storage element is charged. The energy storage element is discharged while the lubricant feed is being reloaded and the lubricant stored in the lubricant storage is accordingly pressed into the pressure chamber.

It is also advantageous when the outlet nozzle is the inlet nozzle of a downstream hydrodynamic pressure nozzle for coating and forming or the inlet nozzle of a downstream chamber for coating.

And it is also advantageous when a plurality of downstream hydrodynamic pressure nozzles are provided for coating and forming or a plurality of downstream chambers are provided for coating.

Forming dies with a surface hardness of only <60 RHC (Rockwell hardness) can be used in an advantageous manner for the device according to the invention.

Solid lubricant is preferably introduced into the pressure chamber. The device according to the invention and the method according to the invention offer the great advantage that lubricant can be used not only in powder form, but also in the form of molded bodies, e.g., compacts, pellets or granules. This results in numerous advantages which will be described more fully hereinafter. However, the device according to the invention also operates with pasty lubricant, i.e., lubricant with a doughy or clay-like consistency.

The lubricant is under pressure which can be set or regulated. The pressure is applied externally, that is, from the outside. For this purpose, there is at least one apparatus by means of which the pressure can be generated and also set and/or regulated. However, there can also be another apparatus in addition to the apparatus for pressure generation for setting and/or regulating pressure.

The utilized combination of pressure and temperature must always lie outside the range of pressure-temperature combinations within which liquefaction of the applied lubricant occurs. When this condition is met, there is at all times during the process according to the invention only solid to pasty lubricant in the pressure chamber.

The pressure chamber contains at least one inlet nozzle and one outlet nozzle. For forming the rod-shaped metal material, the inlet nozzle or the outlet nozzle can be constructed as a drawing die or both the inlet nozzle and outlet nozzle can be constructed as drawing dies. In the most advantageous variant, the outlet nozzle is constructed as a drawing die.

Insofar as the device is intended not for forming but only for coating rod-shaped metal material with lubricant, none of the nozzles is designed as a forming drawing die.

The pressure chamber further has at least one feed for the lubricant. The lubricant removed for coating and/or forming the rod-shaped metal material is replaced with fresh lubricant by means of this lubricant feed. For this purpose, the lubricant feed must be designed in such a way that the set and/or regulated pressure acting on the lubricant in the pressure chamber is kept as constant as possible during a coating process and/or forming process. This can be achieved, among other ways, in an advantageous manner in that two oppositely located lubricant feeds are used. Accordingly, lubricant can be introduced into the pressure chamber by a lubricant feed, while the other feed is filled with lubricant at the same time. A constant or only slightly fluctuating pressure can be maintained in the pressure chamber by sealing the respective lubricant feed being filled.

Another possibility for introducing lubricant without a substantial drop in pressure in the pressure chamber consists in providing only one lubricant feed and, opposite to that, a lubricant storage with a chargeable energy storage element. In so doing, lubricant is pressed into the lubricant storage and the energy storage element is charged. The energy storage element is discharged while the lubricant feed is being reloaded with lubricant, and the lubricant stored in the lubricant storage is pressed in the pressure chamber.

In an advantageous manner according to the invention, a flow divider is installed in the pressure chamber between the lubricant feed opening and the rod-shaped metal material. This flow divider divides the flow of lubricant before it reaches the rod-shaped metal material and accordingly substantially prevents a deflection of the material to one side.

As the rod-shaped metal material passes through the pressure chamber and the nozzles, the solid to pasty lubricant persists in adhering to the entire surface of the material to be formed. This adhesion is so good that, e.g., for a great many types of material, a number of forming steps can be realized without interim coating or additional advantages to be indicated hereinafter are achieved.

Due to this strong adhesion of the lubricant to the material to be formed, it is also possible for unwanted reaction layers, e.g., scale, on the surface of the material which, as is known, loosen during the forming, to be embedded in the lubricant layer on the material so that they can subsequently be removed along with the lubricant layer.

In the event of that the passage of the material through the pressure chamber is interrupted due to production factors, e.g., as a result of wire breakage or other common manufacturing problems, known problems relating to restarting are solved according to the invention in that the relative movement occurring between the material and the forming die during the forming process is temporarily reversed and/or the pressure applied to the lubricant in the pressure chamber is reduced.

Further, with the method according to the invention and the device according to the invention, it is possible to use heated material. Accordingly, heated and/or cooled lubricant can also be used. This means that both heated and cooled lubricant can be used or cooled lubricant can be contained in one part of the device, e.g., in the lubricant feed, and heated lubricant in another part of the device, e.g., in the pressure chamber, simultaneously.

Further advantages of the method according to the invention and the device according to the invention are indicated hereinafter.

Due to the geometric ratios in the region of the inlet nozzle and owing to the viscosity of the lubricant, the prevailing pressure at the output of the inlet nozzle is continuously reduced to zero until the start of the cylindrical guiding region of the inlet nozzle. Accordingly, it is not compulsory to provide forming for sealing at this location.

Another substantial advantage of the method according to the invention consists in that it is not absolutely necessary that a material coated with lubricant be fed to the device.

It is also advantageous that the applied lubricant layer thickness can be controlled by controlling the pressure in the pressure chamber, and layer thicknesses can be greater than in the prior art so that the individual and overall forming degree is greater. Further, the startup phase is extremely short compared with hydrodynamic pressure nozzles, since excellent lubrication conditions are achieved right from the start of the forming process.

Further, a substantial reduction in lubricant consumption is achieved, since there are no losses due to uncontrolled output or chemically and physically altered lubricant which can no longer be used.

The widespread use in the prior art of powered lubricants can be dispensed with as a result of the use of lubricant in the form of molded articles according to the invention. In this way, the unhealthy and environmentally unsound dust burden occurring in the production, transport and use of lubricant powders is avoided.

Another substantial advantage consists in that the previous costly and environmentally unsound use of lubricant carrier layers is no longer necessary in most forming applications due to the excellent lubrication conditions achieved in accordance with the invention. Consequently, the corresponding surface treatment baths, which are usually heated, can also be dispensed with, so that the space requirement in production rooms and the consumption of energy and raw material are also substantially reduced.

It is also noteworthy that entirely new combinations of existing plant techniques are also made possible by using the invention because, for instance, separate lubricant coating units are no longer necessary or in that the technical limits of the individual plant steps can be expanded, e.g., in that it is no longer necessary to allow for lubricant drying times. At the same time, a greater variety can be realized in the forming process with respect to a planned orientation to the processing steps following the forming process.

The specific features of the lubricant used according to the invention also provide the possibility of developing novel lubricant combinations.

Also, an improved storage of the lubricant is now possible since the lubricant in the form of molded articles is no longer as susceptible to moisture and requires less space.

The invention can also influence product quality by defined forming, expansion of technological possibilities with respect to parameters, e.g., higher degree of forming, more stable and constant lubricating conditions, and higher drawing speeds.

It s also possible to realize the aimed for adjustment of the surface quality of the material to be formed and to make better use of material plasticity due to the improved stress state during forming.

In the following, the invention is described more fully with reference to embodiment examples and the accompanying drawings.

DESCRIPTION OF THE PREFERRED EMBODIMENTS

EXAMPLE 1

Figure 1:
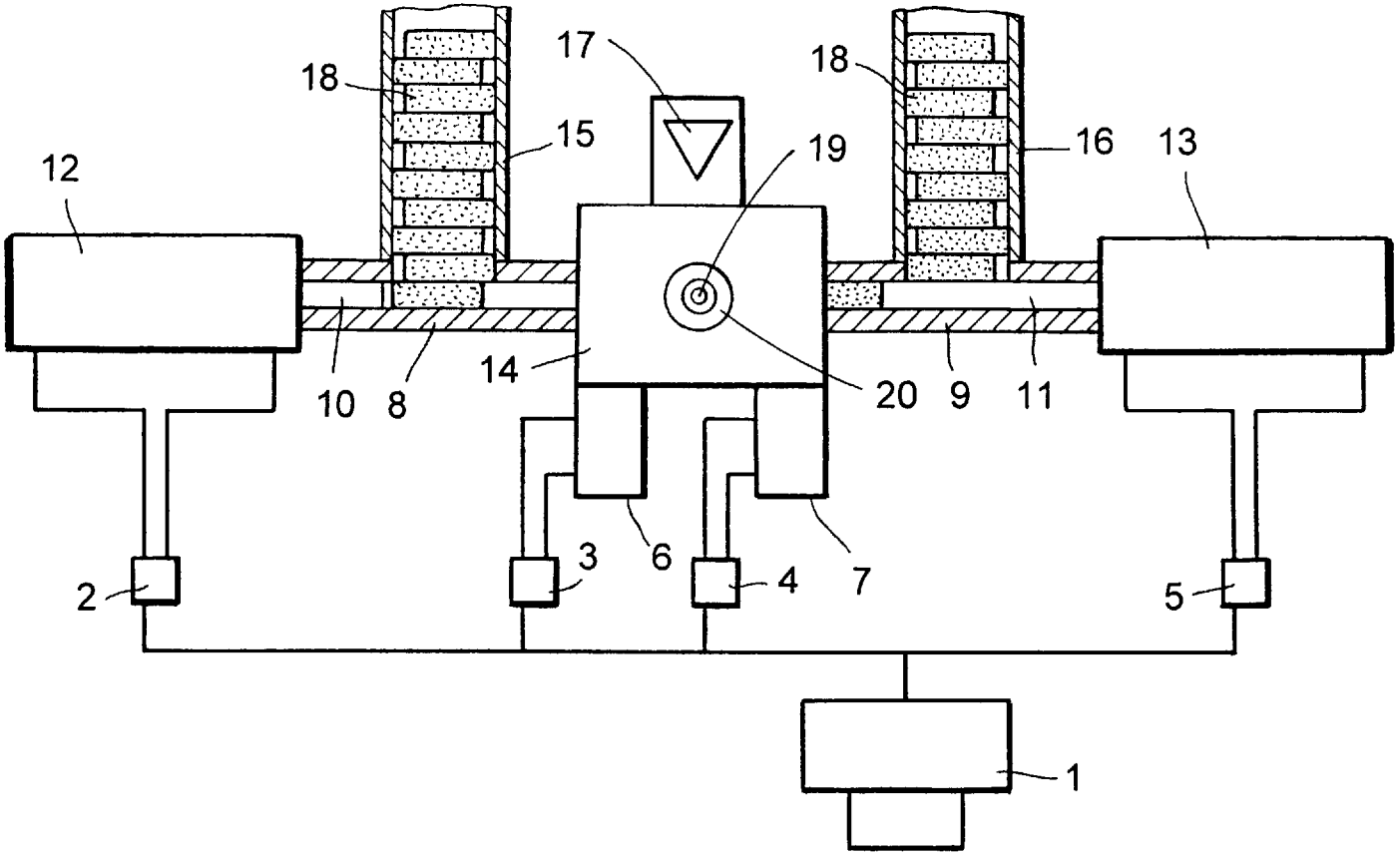
FIG. 1 shows a schematic view of the device, according to the invention, for coating a wire with a solid-lubricant film with simultaneous forming as the wire exits the pressure chamber.
Figure 2:
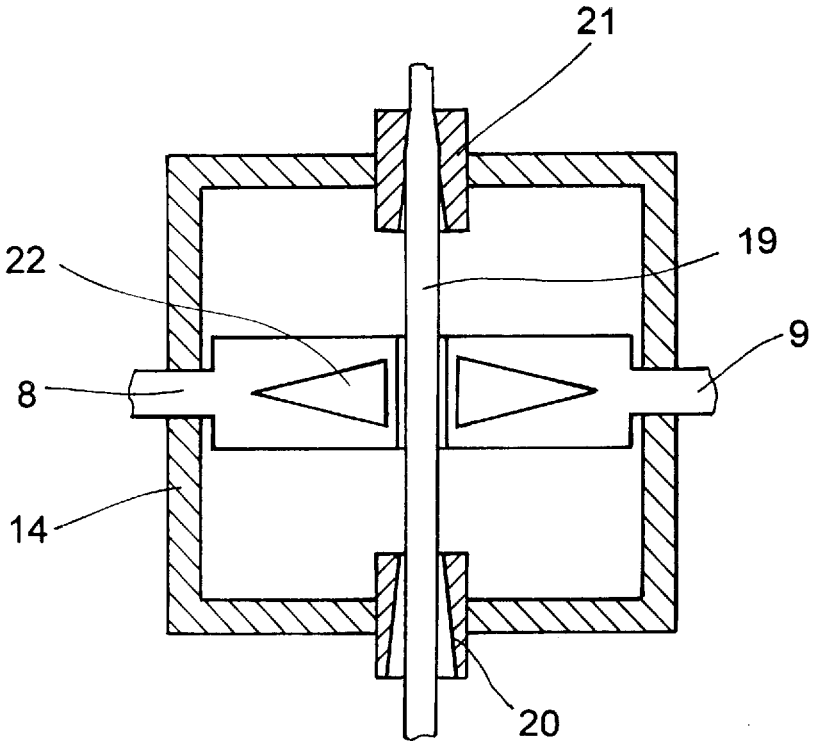
FIG. 2 is a top view of FIG. 1 showing the schematic construction of the pressure chamber with a flow divider.

The main component parts of the device described in this example and shown in the accompanying FIGS. 1 and 2 are as follows:

a pressure chamber 14, an inlet nozzle 20 and outlet nozzle 21, each designed as a drawing die, a feed comprising feed chutes 15; 16 for lubricant compacts 18 and feed ducts 8; 9 enabling further transport of the lubricant compacts 18 from the feed chutes 15; 16 into the pressure chamber 14, and an apparatus for generating pressure comprising hydraulic cylinders 12; 13 for pressure generation in the pressure chamber 14, with valves 2; 5 and pressure rams 10; 11, a central hydraulic unit 1, a pressure measuring device 17, and hydraulic cylinders 6; 7 with associated valves 3; 4 for valving off the pressure chamber 14. A D9-grade, uncoated breakdown-drawn or predrawn steel wire 19 is coated and formed by this device.

A flow divider 22 can advantageously be installed in the pressure chamber 14, as is illustrated in FIG. 2, in order to divide the lubricant flow before reaching the uncoated predrawn steel wire 19.

The valves 2; 3; 4; 5 are controlled via a control unit with a programmable memory connected to the central hydraulic unit 1.

A sodium stearate-based lubricant is used as solid lubricant.

The uncoated predrawn steel wire 19 passes through the inlet nozzle 20 into the pressure chamber 14. In this case, the inlet nozzle 20 is formed of a drawing die whose inner diameter is 0.04 mm greater than the outer diameter of the uncoated predrawn steel wire 19.

When exiting the pressure chamber 14, the steel wire 19 which is now coated passes the outlet nozzle 21 which in this case is formed of a drawing die which shapes the coated steel wire 19 with a cross-sectional reduction of 30%.

The introduction of lubricant into the pressure chamber 14 is effected in the following manner:

First, the lubricant compact 18 which passes from the feed chute 16 into the feed duct 9 and is further compacted therein with a force of 100 kN is introduced into the pressure chamber 14 by means of the hydraulic cylinder 13 and the pressure ram 11 connected therewith.

During this process, the pressure chamber 14 is closed off from the feed duct 8 by means of the hydraulic cylinder 6.

At the same time, the pressure ram 10 connected with the hydraulic cylinder 12 moves toward the rear. This releases the opening in the feed duct 8 and the next lubricant compact 18 falls from the feed duct 15 through this opening into feed duct 8. The lubricant compact 18 is then transported by the pressure ram 10, which after reaching the rear end position again moves in the direction of the pressure chamber 14, into the feed duct 8 which is closed by the hydraulic cylinder 6, and the lubricant compact 18 is further compacted in the feed duct 8 with a force of 100 kN.

When the pressure ram 11 has reached its front end position, the hydraulic cylinder 7 interrupts the connection between the pressure chamber 14 and the feed duct 9, while the hydraulic cylinder 6 simultaneously opens the connection between the pressure chamber 14 and the feed duct 8 again so that the compressed lubricant compact 18 can be introduced into the pressure chamber 14.

The pressure ram 11 now moves into its rear end position, and the reloading process starts anew.

The steel wire 19 moving at a speed of 1.5 m/s through the pressure chamber 14 is coated with a homogeneous, thin, and securely adhering solid-lubricant film with the lubricant at 40° C. under a pressure of 150 MPa.

This film enables the forming of the steel wire 19 in the outlet nozzle 25 which is designed as a drawing die. At the same time, the film is pressed on so firmly that it is possible for the steel wire 19 to undergo further forming steps without additional lubricant.

The alternate reloading of the pressure chamber 14 with compacted lubricant is effected throughout the forming process.

The pressure of the lubricant in the pressure chamber 14 is kept constant at 150 MPa by means of a control unit which is connected to the central hydraulic unit 1 and which has a programmable memory and by the pressure measuring device 17.

EXAMPLE 2

An important mode of carrying out the invention is given in Example 2.

Figure 3:
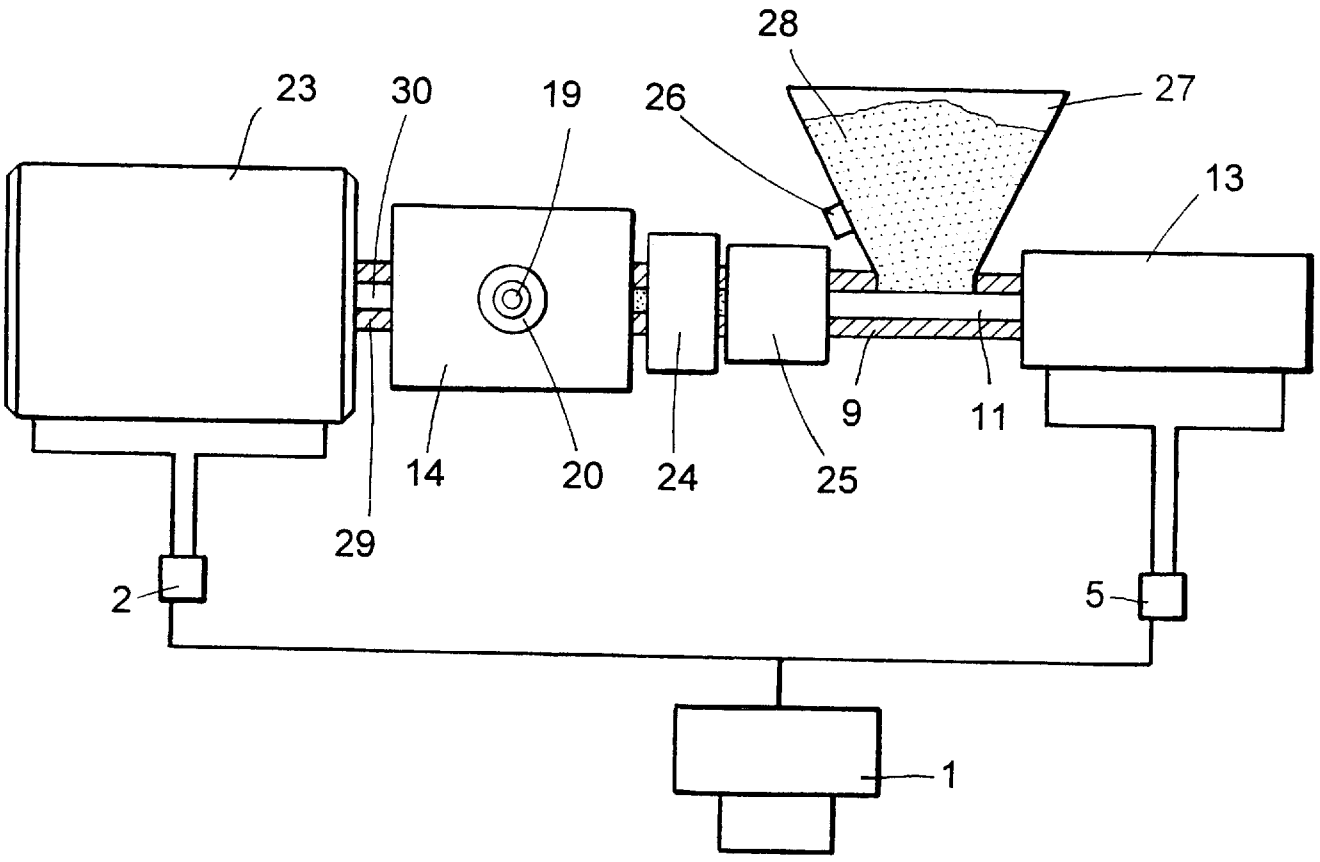
FIG. 3 shows a schematic view of the device, according to the invention, with a lubricant feed and a lubricant storage.

The main component parts of the device according to the invention described in this example and shown in the accompanying FIGS. 2 and 3 are:

the pressure chamber 14, the inlet nozzle 20 and outlet nozzle 21, each of which is designed as a drawing die, a lubricant feed comprising a powder hopper 27 for powder lubricant 28, and the feed duct 9 which enables continued transport of the lubricant powder 28 into the pressure chamber 14 from a lubricant storage 29 with a chargeable energy storage element 30, electric heating means 25 serving to heat the lubricant powder during the pressing and transport in the feed duct 9, and an apparatus for generating pressure comprising the hydraulic cylinder 13 for generating pressure in the pressure chamber 14, with valve 5 and pressure ram 11, the central hydraulic unit 1, a nonreturn valve 24 for valving off the pressure chamber 14 during the reloading of the feed duct 9, the hydraulic cylinder 23 with associated valve 2, and the lubricant storage 29 with the chargeable energy storage element 30.

A predrawn high-grade steel wire 19 provided with a lubricant residue film remaining from the previous forming step is re-coated and formed by this device.

A flow divider 22 can advantageously be installed in the pressure chamber 14, as is illustrated in FIG. 2, in order to divide the lubricant flow before reaching the high-grade steel wire 19.

The valves 2 and 5 are controlled via a control unit with a programmable memory connected to the central hydraulic unit 1.

A calcium stearate-based lubricant powder is used as solid lubricant.

The high-grade steel wire 19 passes through the inlet nozzle 20 into the pressure chamber 14. In this case, the inlet nozzle 20 is formed of a drawing die whose inner diameter is 0.02 mm greater than the outer diameter of the high-grade steel wire 19.

As it exits the pressure chamber 14, the high-grade steel wire 19, which is now coated again, passes the outlet nozzle 21 which in this case is a drawing die which forms the coated high-grade steel wire 19 with a cross-sectional reduction of 22%.

The introduction of lubricant into the pressure chamber 14 is effected in the following manner:

First, the lubricant powder 28 which passes from the powder hopper 27 to the feed duct 9 and is further compacted therein with a force of 110 kN is introduced into the pressure chamber 14 by means of the hydraulic cylinder 13 and the pressure ram 11 connected therewith.

In order to facilitate compaction of the lubricant powder 28 and transport in the feed duct 9, the lubricant powder 28 located in the feed duct 9 is heated to a temperature of 60° C. by electrical heating means 25.

While the compacted lubricant powder 28 is being introduced into the pressure chamber 14 from the feed duct 9, the pressure chamber 14 is opened relative to the lubricant storage 29 so that a portion of the lubricant located in the pressure chamber 14 enters the lubricant storage 29 and displaces the energy storage element 30, which is chargeable by means of the hydraulic cylinder 23, against the oil pressure in the hydraulic cylinder. The energy storage element 30 is accordingly charged.

When the pressure ram 11 has reached its front end position, the nonreturn valve 24 interrupts the connection between the pressure chamber 14 and the feed duct 9. At this point in time, the lubricant which is stored in the lubricant storage 29 is introduced into the pressure chamber 14 from the lubricant storage 29 which is open relative to the pressure chamber 14 in that the energy storage element 30 discharges.

The pressure ram 11 now moves into its rear end position, and the reloading process starts anew.

The filling level sensor 26 monitors the supply of lubricant powder 28 in the powder hopper 27.

The high-grade steel wire 19 moving through the pressure chamber 14 at a speed of 2.0 m/s is re-coated with a homogeneous, thin, and firmly adhering solid-lubricant film with the lubricant at 60° C. under a pressure of 135 MPa.

This film makes it possible for the high-grade steel wire 19 to be formed in the outlet nozzle 25 which is designed as a drawing die. The film is so firmly impressed simultaneously in the outlet nozzle 25 that it is possible for the high-grade steel wire 19 to undergo further forming steps without additional lubricant coats.

The alternate reloading of the pressure chamber 14 with compacted lubricant is effected throughout the entire forming process.

The pressure of the lubricant in the pressure chamber 14 is kept constant at 135 MPa by means of a control unit which is connected to the central hydraulic unit 1 and which has a programmable memory and by the pressure measuring device 17.

While the foregoing description and drawings represent the present invention, it will be obvious to those skilled in the art that various changes may be made therein without departing from the true spirit and scope of the present invention.

What is claimed is:

1. A method for forming and/or coating rod-shaped metal material with solid to pasty-consistency lubricants, comprising the steps of:

allowing rod-shaped metal material to run into a pressure chamber through at least one inlet nozzle and exiting the pressure chamber through at least one outlet nozzle;

introducing solid to pasty lubricant into the pressure chamber;

applying pressure externally to the solid to pasty lubricant located in the pressure chamber;

providing that applied combination of pressure and temperature always lies outside of the range of pressure-temperature combinations at which the utilized lubricant would liquefy; and at least one of setting and regulating the pressure in the pressure chamber.

2. The method according to claim 1, in which the method is used one or more times in a multiple-step forming process.

3. The method according to claim 1, in which the relative movement between the material to be formed and a forming die is temporarily reversed during the forming process immediately after an interruption in the forming process and/or the pressure applied to the lubricant is reduced.

4. The method according to claim 1, in which a material having a reaction layer is formed, wherein the reaction layer detaching from the material while it is undergoing forming is embedded in the lubricant on the material and is subsequently removed together with the lubricant.

5. The method according to claim 1, in which lubricant (18; 28) is introduced into the pressure chamber by a lubricant feed and, in so doing, lubricant is stored in an oppositely located lubricant storage (29), wherein a chargeable energy storage element is charged, and the energy storage element is discharged during the reloading of the lubricant feed so that the stored lubricant is pressed into the pressure chamber.

6. The method according to claim 1, in which the rod-shaped metal material runs through an adjoining hydrodynamic pressure nozzle following the pressure chamber for coating and forming or through an adjoining chamber for coating.

7. The method according to claim 1, in which the rod-shaped metal material runs through a plurality of successive hydrodynamic pressure nozzles for coating and forming or a plurality of successive chambers for coating.

8. The method according to claim 1, in which the solid lubricant is introduced into the pressure chamber as powder.

9. The method according to claim 1, in which the material to be formed is guided centrally in the pressure chamber through a directed flow of the introduced lubricant.

10. The method according to claim 1, further comprising the step of feeding heated material to the pressure chamber.

11. The method according to claim 1, in which the lubricant is heated and/or cooled.

12. The method according to claim 1, in which the solid lubricant is introduced into the pressure chamber as a molded body.

13. The method according to claim 12, wherein the molded body is a compact or pellet or granule.

14. The device for forming and/or coating rod-shaped metal material with solid to pasty lubricants comprising:

a pressure chamber with at least one inlet nozzle and at least one outlet nozzle through which the material to be formed passes;

at least one feed for solid to pasty lubricant;

solid to pasty lubricant under pressure in the pressure chamber, wherein the pressure is applied externally; the applied combined pressure and temperature always lying outside of the range of pressure-temperature combinations at which the utilized lubricant liquefies;

at least one apparatus for pressure generation; and means for at least one of setting and regulating the pressure.

15. The device according to claim 14, in which, for purposes of forming, only the outlet nozzle is constructed as a drawing die.

16. The device according to claim 14, in which two oppositely located lubricant feeds are provided, which introduce solid to pasty lubricant into the pressure chamber, wherein the solid lubricant is used as a powder.

17. The device according to claim 14, in which the pressure is generated hydraulically.

18. The device according to claim 14, in which a flow divider divides the flow of lubricant before it reaches the metal material in the pressure chamber.

19. The device according to claim 14, in which are arranged a lubricant feed and, opposite thereto, a lubricant storage with a chargeable energy storage element, wherein the lubricant storage stores lubricant and, in so doing, charges the energy storage element, and the discharging of the energy storage element presses the stored lubricant into the pressure chamber during the reloading of lubricant into the lubricant feed.

20. The device according to claim 14, in which the outlet nozzle is the inlet nozzle of a following hydrodynamic pressure nozzle for coating and forming or the inlet nozzle of a following chamber for coating.

21. The device according to claim 14, in which a plurality of downstream hydrodynamic pressure nozzles are provided for coating and forming or a plurality of downstream chambers are provided for coating.

22. The device according to claim 11, in which forming dies with a surface hardness of only <60 RHC is used.

23. The apparatus according to claim 14, wherein the means for setting and/or regulating the pressure is provided by said pressure generating apparatus.

24. The apparatus according to claim 14, wherein the means for setting and/or regulating the pressure is provided by an additional apparatus.

25. The device according to claim 14, in which two oppositely located lubricant feeds are provided, which introduce solid to pasty lubricant into the pressure chamber, wherein the solid lubricant is used a molded body.

26. The device of claim 25, wherein the molded body is a compact or pellet or granule.

* * * * *